US007779512B2

(12) United States Patent
Bernhardt et al.

(10) Patent No.: US 7,779,512 B2
(45) Date of Patent: Aug. 24, 2010

(54) APPARATUS AND METHOD FOR FEEDING FIBERS

(75) Inventors: Siegfried Bernhardt, Bremen (DE); Robert Kamprath, Bremen (DE); Heinz-Werner Naumann-Burghardt, Berne (DE)

(73) Assignee: Oskar Dilo Maschinenfabrik KG (DE)

( * ) Notice: Subject to any disclaimer, the term of this patent is extended or adjusted under 35 U.S.C. 154(b) by 150 days.

(21) Appl. No.: 12/143,473

(22) Filed: Jun. 20, 2008

(65) Prior Publication Data

US 2008/0313860 A1 Dec. 25, 2008

(30) Foreign Application Priority Data

Jun. 25, 2007 (EP) ..... 07110930

(51) Int. Cl.
*D01G 15/40* (2006.01)

(52) U.S. Cl. ..... 19/105; 19/97.5

(58) Field of Classification Search ..... 19/97.5, 19/105

See application file for complete search history.

(56) References Cited

U.S. PATENT DOCUMENTS 4,939,815 A * 7/1990 Leifeld ..... 19/105
5,333,358 A * 8/1994 Leifeld ..... 19/105
5,479,679 A * 1/1996 Leifeld ..... 19/105
5,611,116 A 3/1997 Leifeld
6,163,931 A * 12/2000 Leifeld ..... 19/105
6,167,593 B1 1/2001 Leifeld
6,173,478 B1 * 1/2001 Patelli et al. ..... 19/105
6,216,318 B1 * 4/2001 Leifeld ..... 19/105

FOREIGN PATENT DOCUMENTS

DE 198 26 071 12/1999
EP 0 972 866 1/2000

* cited by examiner

*Primary Examiner*—Shaun R Hurley
(74) *Attorney, Agent, or Firm*—Jansson Shupe & Munger Ltd.

(57) ABSTRACT

A feeding device for fiber flocks or opened fibers for feeding a textile machine, especially a carding machine, has a first, upper vertical fiber chute which supplies the fibers or fiber flocks to rolls for opening of the fibers, and a lower fiber chute which accepts the fibers released by the rolls and discharges a fiber mat at the bottom end of the fiber chute by way of discharge rolls. The feeding device also has a segmented intake trough with several intake trough segments which cooperate with a segmented, clothing-covered first roll, which is divided into several roll segments, wherein the torque of the roll segments can be controlled individually and the widths of the gaps between the intake trough segments and the associated roll segments can be adjusted on a segment-by-segment basis.

34 Claims, 8 Drawing Sheets

APPARATUS AND METHOD FOR FEEDING FIBERS

CROSS REFERENCE TO RELATED APPLICATION

This application claims priority based on European patent application EP 07 110 930.0, filed Jun. 25, 2007.

FIELD OF THE INVENTION

The invention pertains to feeding devices for fiber flocks or opened fibers for feeding textile machines, especially carding machines, and also pertains to methods for feeding fibers to textile machines.

DESCRIPTION OF THE PRIOR ART

In these types of feeding devices, the fiber mat supplied to the downstream textile machine should have a high degree of uniformity in both the longitudinal and transverse directions. A basic problem of these types of devices is ensuring that the fibers which have been separated from the transport air stream in an upper section of the chute are distributed with uniform density across the width of the chute and also in the longitudinal direction.

It is known from EP 0 972 866 A that an equalizing device consisting of segmented rolls can be provided downstream of the feeding device. The segments of the rolls of this equalizing device rotate at different speeds. Controlling the speed of the individual roll segments involves the problem that, when one of the roll segments of a roll is rotating at high speed, a thin spot can form, because not enough fresh material can be brought up from the rear to compensate.

SUMMARY OF THE INVENTION

It is an object of the present invention to provide a feeding device and a method for supplying opened fibers or fiber flocks, in which the variations in the weight of the discharged fiber mat are minimized and fluctuations are smoothed out.

The invention is a feeding device for fiber flocks or opened fibers for feeding a textile machine, especially a carding machine, wherein the fibers or fiber flocks can be supplied by a pneumatic fiber transport device, with a first upper vertical fiber chute which supplies the fibers or fiber flocks to rolls for opening the fibers, and a lower fiber chute which receives the fibers released by the rolls and discharges a fiber mat at the bottom end of the fiber chute by way of discharge rolls. The invention advantageously provides that the bottom end of the upper chute supplies the fibers to a segmented intake trough with several intake trough segments, which cooperate with a first segmented, clothing-covered roll, which is divided into several roll segments, wherein the torque of the roll segments can be varied individually, and the width of the gap between an intake trough segment and the associated roll segment can be adjusted or changed on a segment-by-segment basis.

The invention makes it possible to smooth out shortwave changes in fiber density in the fiber mat and to achieve a high degree of uniformity of the fiber mat in the longitudinal direction, wherein, as a result, the density in the transverse direction is also made highly uniform.

The intake trough segments opposite the roll segments can be set in a stationary position, and each can cooperate with one of the individual torque-controlled roll segments. A different torque can be set for each roll segment, wherein the width of the gap between an intake trough segment and the associated roll segment is also individually adjustable. For example, the gap at the outer segments can be approximately 1 mm wider than the gap at the inner segments. The torque control makes it possible to equalize changes in the density of the fiber flocks in the longitudinal direction, because the maximum amount of torque which a roll segment can transmit is limited. Thus, if the density of the fibers being supplied becomes too high, the preset torque limit of the segment will be exceeded, and the segment will slow down and therefore convey fewer fibers, with the result that the density in the longitudinal direction will be made uniform. In this way, the fiber density can be equalized in the transverse direction right at the end of the upper chute, and this then leads to an equalization of the fiber density in the longitudinal direction.

The length of the roll segments is usually the same as the length of the opposing intake trough segments.

The intake trough segments can have finer subdivisions than the roll segments.

The first roll can consist of roll segments of equal length.

The following measures may also be provided: a first compression zone is formed at the end of the intake trough; the first roll transfers the fiber mat to a second clothing-covered roll, which rotates in the same direction as the first roll at the same circumferential velocity as the first roll or at a slower circumferential velocity; and the second roll is provided with a shroud, the distance of this shroud from the second roll decreasing in the direction of rotation of the second roll.

The formation of a first compression zone at the end of the intake trough and the formation of a second compression zone at the end of the second roll can lead to further densification and equalization of the fiber mat in the longitudinal and transverse directions. The second compression zone prevents the fiber flocks from opening again undesirably after they have been densified.

The second roll preferably transfers the densified fiber mat at the end of the shroud to a rapidly rotating third roll, which discharges the densified fiber mat into the lower chute.

The third, rapidly rotating roll can open the densified fiber mat again and throws it into the lower chute, where preferably an air stream directed at the periphery of the roll helps to separate the fibers from the rapidly rotating third roll.

It may be provided that the rapidly rotating third roll rotates in the direction opposite that of the first two rolls to card coarse or long fibers and that the rapidly rotating third roll rotates in the same direction as the first two rolls to card short fibers.

The rapidly rotating third roll can therefore be operated advantageously in different ways for different fibers. On each side of the rapidly rotating third roll, air channels extending in the transverse direction of the chute across the width of the chute are directed tangentially at the rapidly rotating third roll, wherein, depending on the direction of rotation of the rapidly rotating third roll, the one or the other section of the air channel can be blocked off.

An air stream can therefore be supplied to the rapidly rotating roll at the separation point of the fibers to facilitate the separation of the fibers from the rapidly rotating third roll.

In particular, a pivoting trough is arranged underneath the rapidly rotating third roll. This plate switches position to guide the air stream in correspondence with the rotational direction of the rapidly rotating third roll, i.e., so that the stream travels along the rapidly rotating third roll in the same direction that the roll is rotating.

The rapidly rotating third roll and the first two rolls can be equipped with pins or covered with clothing.

The roll segments of the first roll are preferably supported on a common shaft, and a clutch transmits a variably adjustable torque to the roll segment in question.

The clutch can be a hysteresis clutch, and the amount of torque which it can transmit can be adjusted by changing the distance between the opposing clutch elements.

Each roll segment, alternatively, can have its own internal motor drive, the torque of which is adjustable.

The torque transmitted to the roll segments can be controlled as a function of a segment-by-segment measurement of the weight per unit area of the discharged fiber mat and/or as a function of a measurement of the level of material in the lower chute downstream of the third roll.

In one exemplary embodiment, the discharge rolls transfer a fiber mat onto a screen belt subjected to suction.

The lower fiber chute can comprise chute walls provided with a shaking device for densification.

Alternatively or in addition, a shaking device can also be located in the pivoting trough.

The air stream supplied to the rapidly rotating third roll can consist of transport air which has been branched off in the upper fiber chute.

Alternatively, the air stream can consist of externally supplied compressed air. The chute walls of the lower fiber chute can be permeable to air.

The width of the gap between an intake trough segment and the associated roll segment can be permanently set on a segment-by-segment basis.

The rotational speed of the shaft of the first roll can be considerably greater than that of the second roll.

As a result, the compression effect in the first compression zone is increased.

The circumferential velocity of the second roll is approximately 5-30 m/min, and preferably 15-25 m/min.

The circumferential velocity of the third roll is at least approximately 600 m/min, and preferably 800-1,200 m/min.

In an inventive method for supplying fibers or fiber flocks to a textile machine, which comprises transporting the fibers to a fiber chute in a transport air stream, separating the transport air stream in the fiber chute (i.e., branching off partial streams) and densifying the fibers or fiber flocks in the fiber chute, opening the fibers or fiber flocks by means of several rolls, and discharging a fiber mat at the bottom end of the fiber chute, a segmented opening of the fibers or fiber flocks in several segments extending across the width of the fiber chute for the production of an emerging fiber mat with a uniform or predefined cross-sectional profile is further provided.

The width of the segments of the intake trough can be determined by the width of the axially adjacent segments of the opposing roll.

The roll segments and/or the intake trough segments can be more finely subdivided especially at their edges.

The segmented opening takes place by individual control of the torque of each of the roll segments.

The segmented opening can also take place by the permanent setting of the width of the gap between the roll segments and the corresponding intake trough segments of an intake trough located opposite the roll segments.

BRIEF DESCRIPTION OF THE DRAWINGS

In the following, exemplary embodiments of the invention are explained in greater detail on the basis of the drawings.

DETAILED DESCRIPTION OF THE INVENTION

Figure 1:
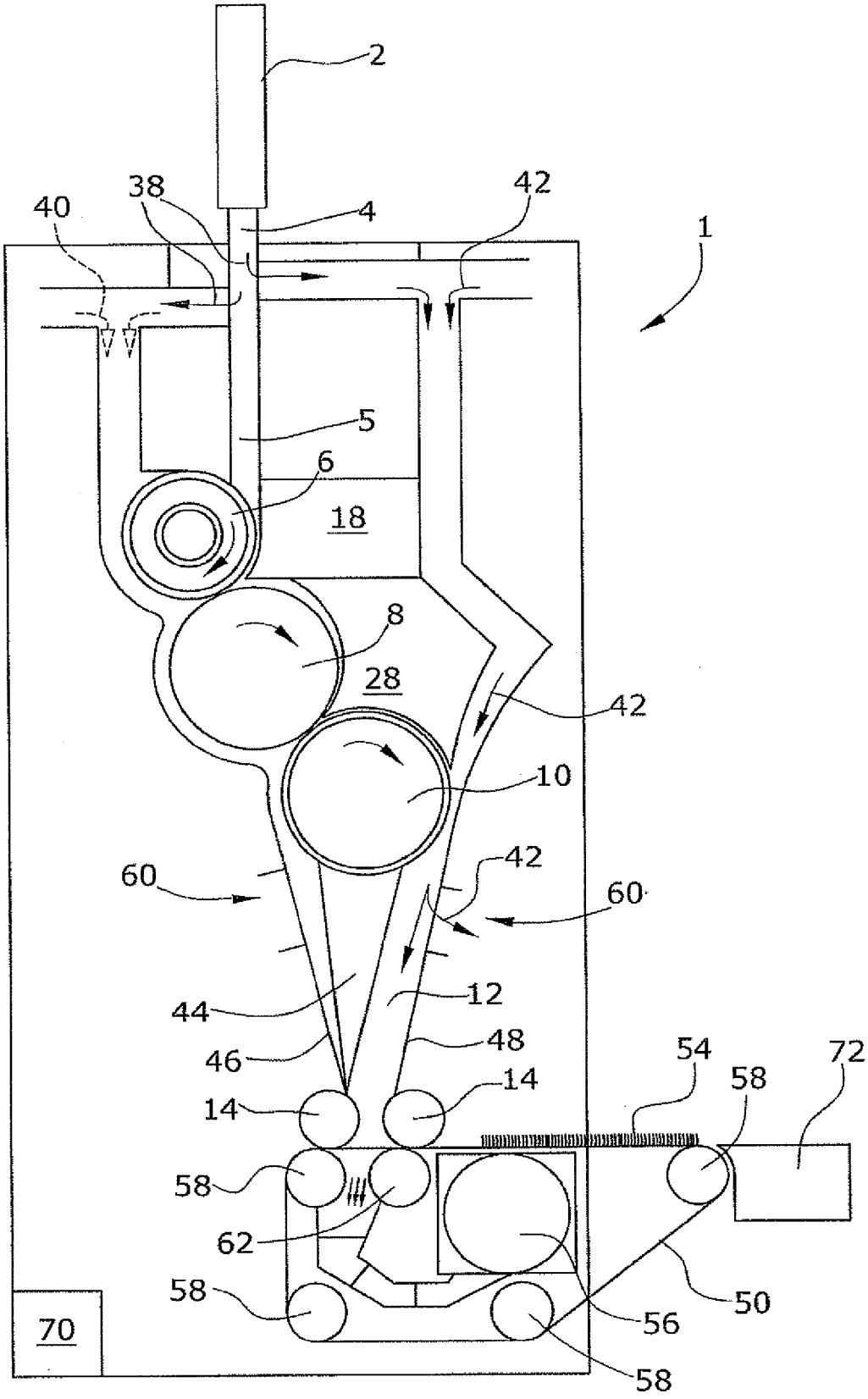
FIG. 1 shows a first exemplary embodiment of the invention in the operating mode suitable for short fibers.
Figure 4:
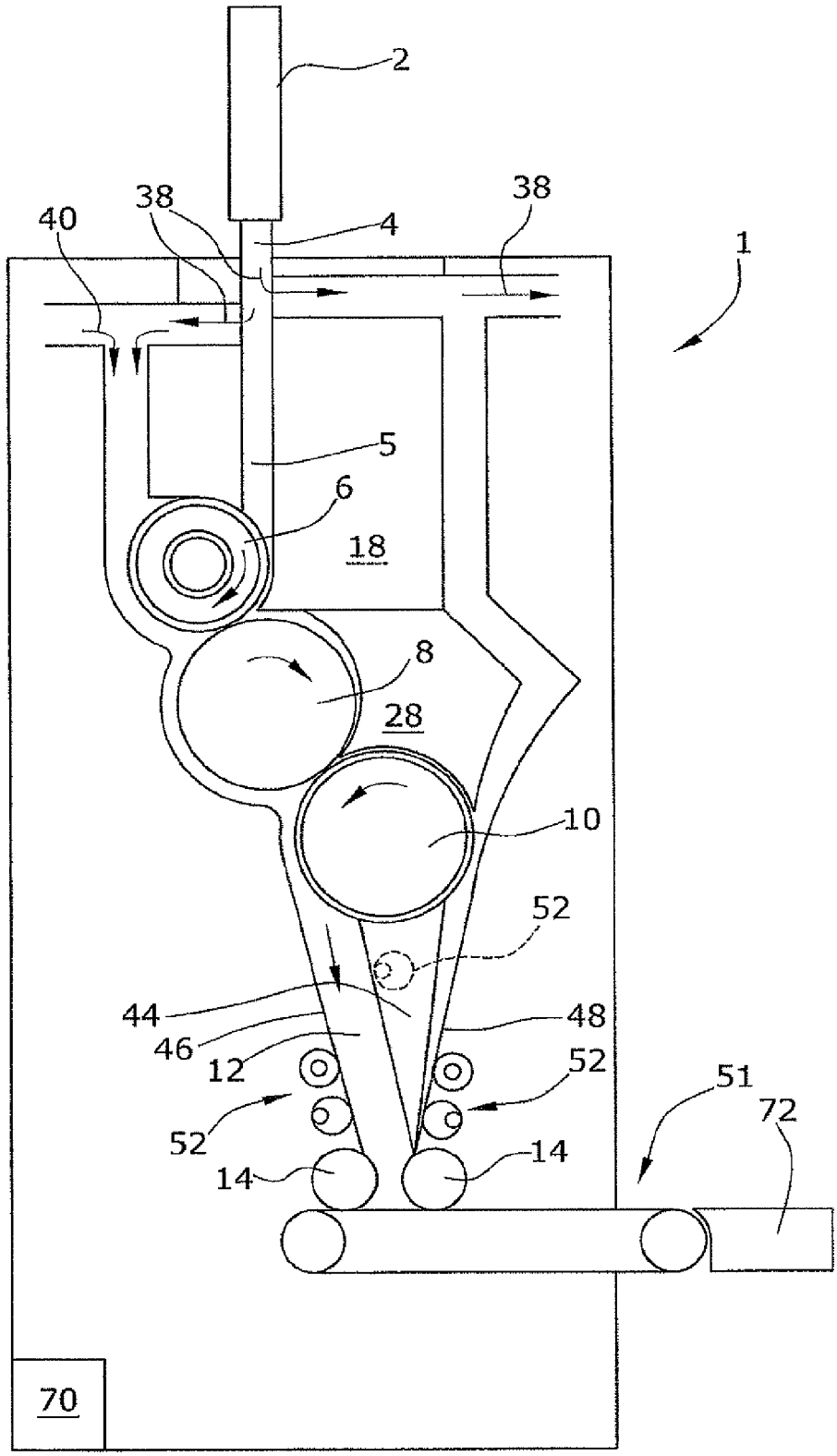
FIG. 4 shows an exemplary embodiment according to FIG. 2 with an endless belt without suction.
Figure 5:
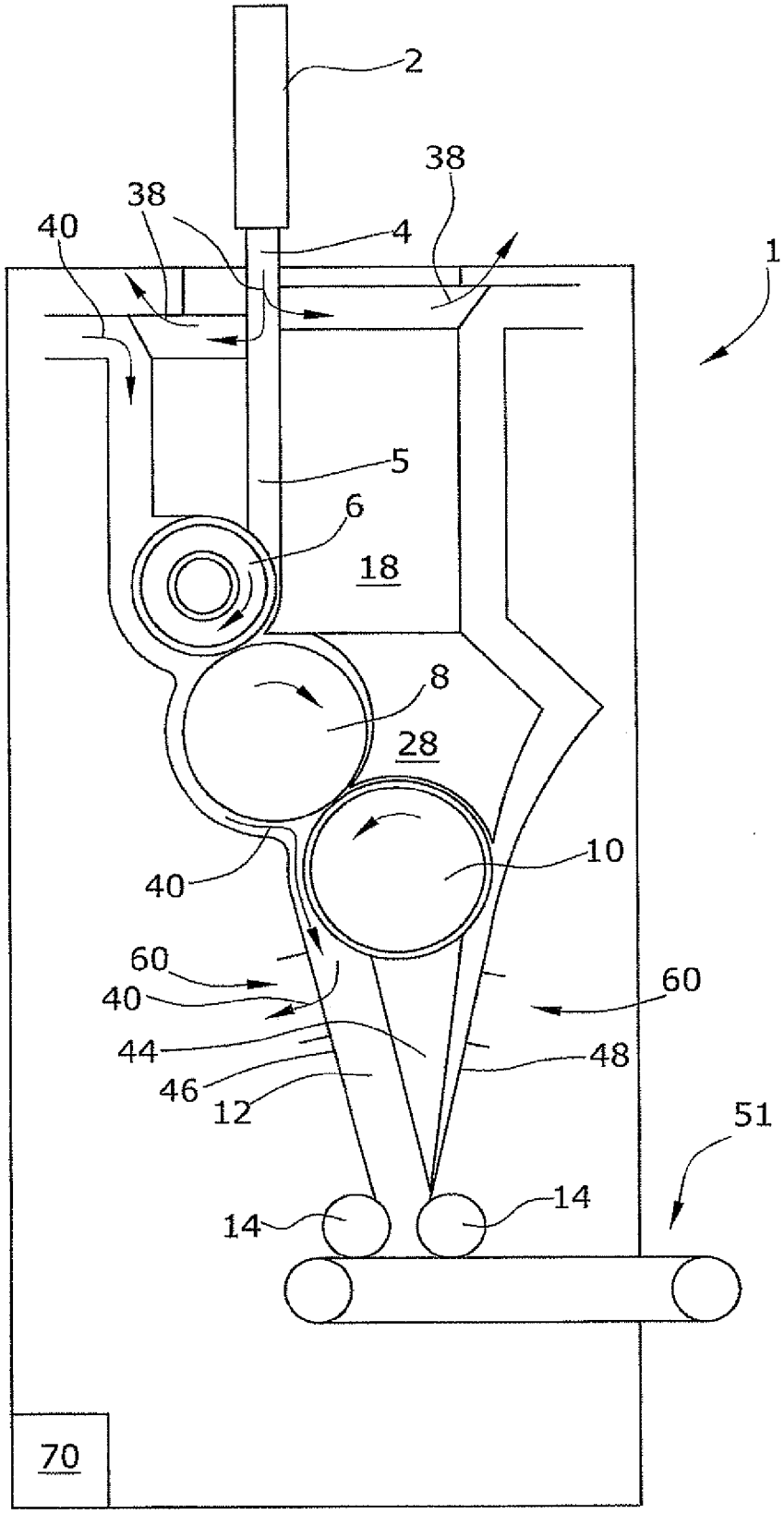
FIG. 5 shows an exemplary embodiment in which compressed air is supplied.
Figure 6:
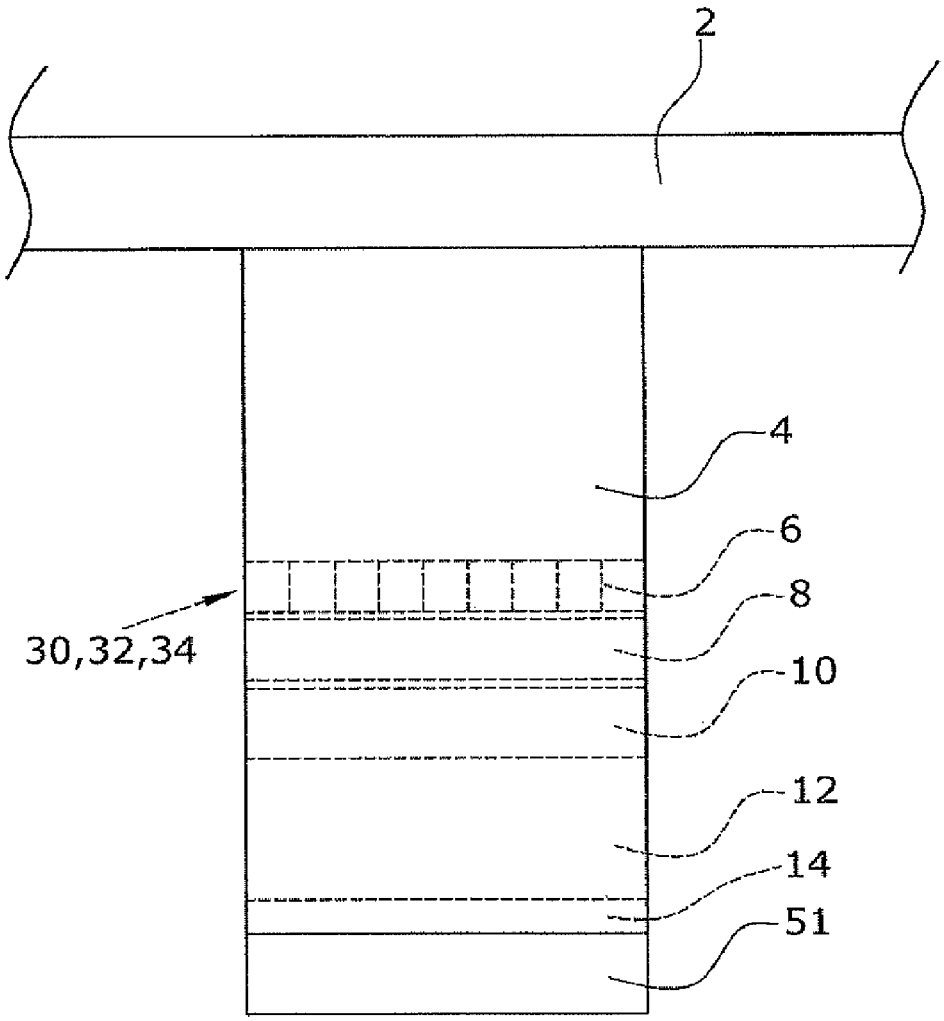
FIG. 6 shows a schematic diagram of a front view of the feeding device.

FIG. 1 shows a feeding device 1 for fiber flocks or opened fibers for feeding a downstream textile machine, especially either a carding machine or a downstream mechanical or thermal solidification device. As can be seen in FIGS. 1 and 6, the fiber flocks are supplied to a first upper vertical fiber chute 4 by means of a pneumatic fiber transport device 2, whereupon the transport air 38 is branched off from the air stream carrying the fibers by means of, for example, comb-like chute wall elements, so that the fiber flocks can collect in the upper fiber chute 4 and increase in density as they proceed toward the bottom end of the upper fiber chute 4. At the bottom end 5 of the upper fiber chute, the fiber flocks are sent to several rolls 6, 8, 10 to open the fiber flocks, which are then collected in a lower fiber chute 12. Discharge rolls 14 discharge a fiber mat at the bottom end of the fiber chute 12. In exemplary embodiments 1 to 3, the fiber mat is deposited onto a screen belt subjected to suction 50 or, alternatively, as can be seen in FIGS. 4-6, onto an endless belt 51 without suction. Some of the separated transport air 38 can be blown off, and at least some of it can be used to form the air stream 40, 42, which helps to separate the fibers from the roll 10, which discharges the fibers into lower fiber chute 12.

In the exemplary embodiment according to FIG. 1, three rolls 6, 8, 10 in all are shown. It is obvious that an arrangement of only two rolls 6, 10 could be provided, in which rapidly rotating roll 10 cooperates directly with the first roll 6.

Figure 7:
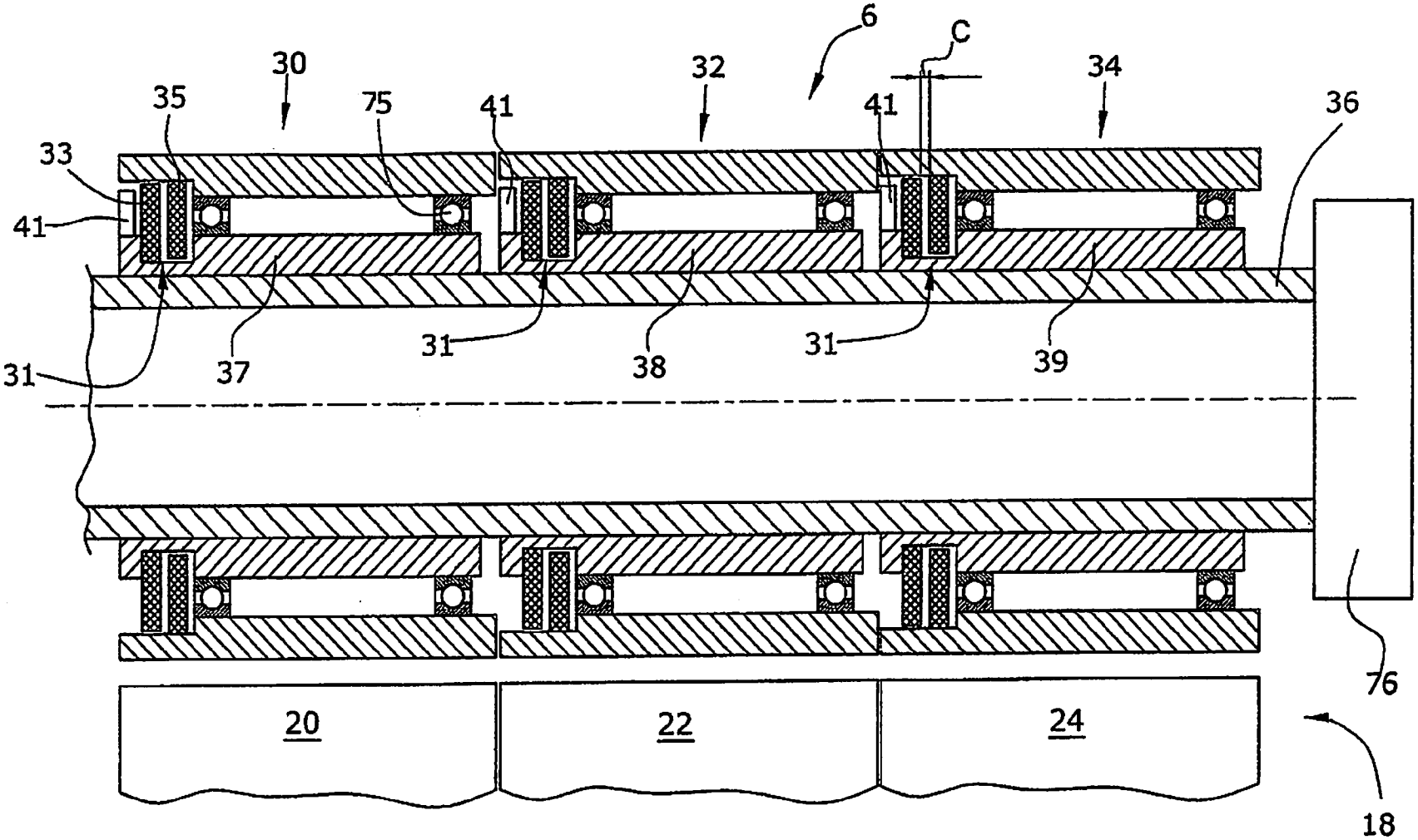
FIG. 7 shows a schematic diagram of the segmented roll and of the segmented intake trough.

First roll 6, which receives the fiber flocks from bottom end 5 of upper fiber chute 4, is divided into several roll segments 30, 32, 34, as can be seen clearly in FIG. 7 in particular. Segmented roll 6 cooperates with a segmented intake trough 18 with preferably the same division of the segments. The division of the segments can be made finer toward the edge; that is, the segments closer to the edges of the fiber mat can be smaller in length than those in the middle. Nevertheless, it is sufficient to arrange roll segments of equal length—possibly nine roll segments—across the width of the fiber mat and merely to reduce the length of the intake trough segments toward the edges. For each of the roll segments 30, 32, 34, a maximum torque can be defined, which can be varied in a controlled manner as a function of, for example, the density distribution in the longitudinal and transverse directions measured downstream of rapidly rotating roll 10. The variably controlled torque of individual roll segments 30, 32, 34 thus makes it possible to smooth out in particular the shortwave fluctuations in the transverse and longitudinal directions by controlling the amount of fibers being supplied right at end of upper fiber chute 4.

The width of the gap between the various intake trough segments 20, 22, 24 and associated roll segments 30, 32, 34 is preferably set permanently on a segment-by-segment basis.

A first compression zone, which also helps to create a uniform distribution of the fibers in the longitudinal and transverse directions, is formed at the end of intake trough 18. Downstream of this compression zone, the fiber mat formed by first roll 6 is transferred to a second, clothing-covered roll 8, which rotates in the same direction as first roll 6 at the same circumferential velocity as that of first roll 6 or at a slower velocity. At such a circumferential velocity, the compressive effect is increased.

Second roll 8 is provided with a shroud, which, as can be seen in FIG. 1, produces a gap, the width of which decreases in the direction of rotation of second roll 8. As a result, a new compression zone is formed, at the end of which the fiber mat is transferred to the rapidly rotating third roll 10. As a result, the fibers are opened again, and they are spun off into lower chute 12 and thus into air stream 42, which is preferably branched off from transport air stream 38 and sent to this lower chute.

Air stream 42 is conducted tangentially past rapidly rotating roll 10 to support the separation of the fibers. The lower chute walls of lower chute 12 are permeable in design. They have, for example, comb-like devices 60 to blow off unneeded portions of air stream 42. Depending on the direction in which rapidly rotating roll 10 rotates, part of lower chute 12 will be blocked off by means of a pivoting trough 44.

Figure 2:
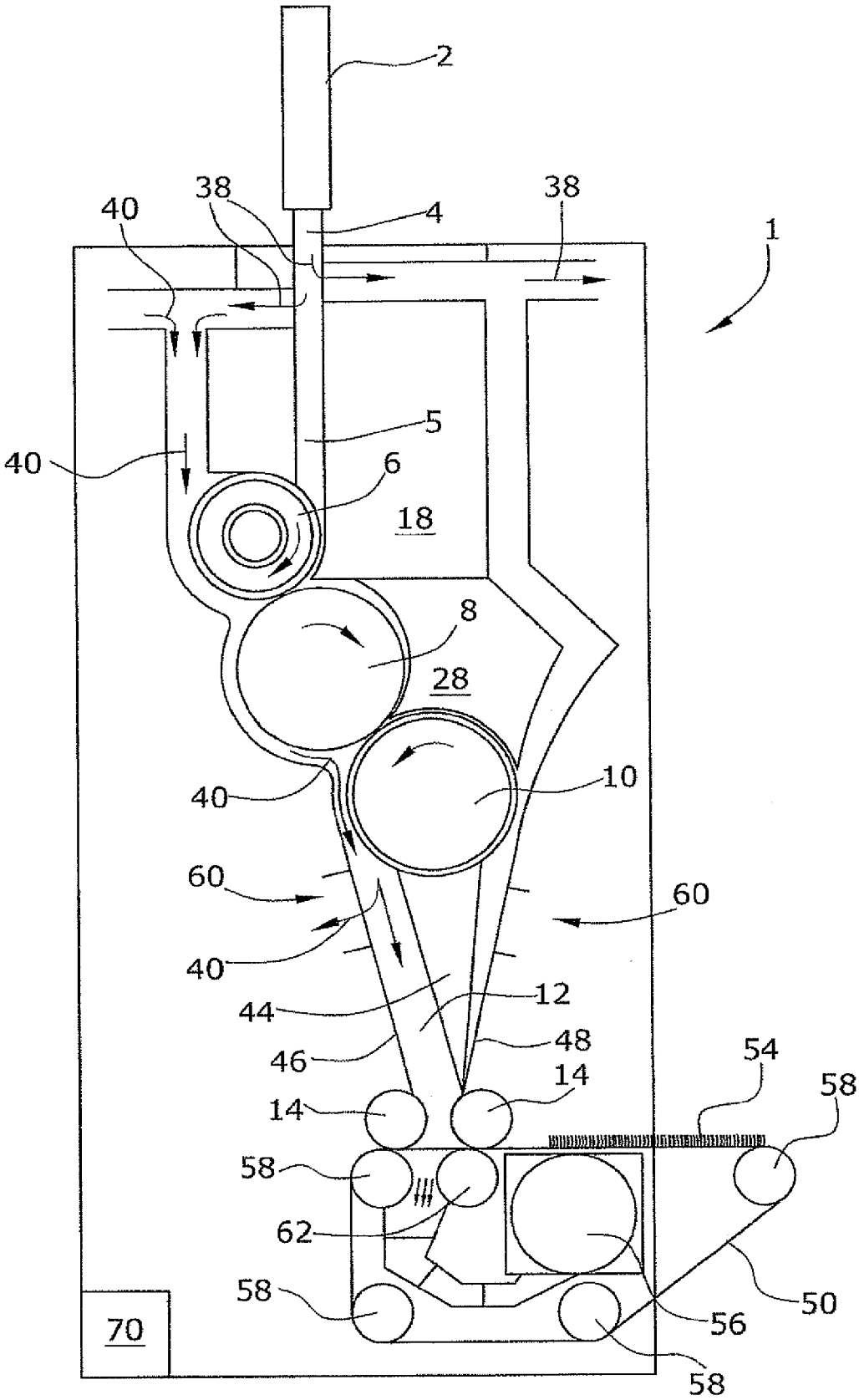
FIG. 2 shows the exemplary embodiment of FIG. 1 in the operating mode suitable for coarse and long fibers.

A comparison of FIG. 1 with FIG. 2 shows how the position of the preferably wedge-shaped pivoting trough 44 changes as a function of the direction of rotation of rapidly rotating roll 10.

Instead of transport air stream 38, air stream 40, 42 can also consist of conditioned air, especially compressed air.

The fibers spun by rapidly rotating roll 10 into lower chute 12 collect in the lower part of the fiber chute and are deposited by discharge rolls 14 onto a screen belt 50, subjected to suction from underneath.

Deflecting rollers 58 guide the endless screen belt 50. One of deflecting rollers 58 and a support roller 62 are arranged opposite discharge rolls 14, wherein a gap, extending across the width of the fiber chute, remains between deflecting roller 58 and support roller 62 to allow the departure of the suctioned-off air stream. A suction fan 56 generates the necessary vacuum. Under certain conditions, air outlet devices 60 on the chute walls can be omitted if the quantity of air supplied by air stream 40 or 42 corresponds to the quantity of air suctioned off by fan 56. The suction funnel (not shown) installed under screen belt 50 and leading to suction fan 56 produces a uniform vacuum across the width of feeding device 1. The vacuum makes it possible to improve considerably the transfer of humidity from the conditioned air to the fiber mat.

A fiber mat 54, which can be supplied to the following machine by a screen belt 50 or by some other transport device, is deposited onto screen belt 50.

In the exemplary embodiment of FIG. 1, the third, rapidly-rotating roll 10 rotates in the same direction as two first rolls 6 and 8. In this position, short fibers can be processed.

The circumferential velocity of rapidly rotating roll 10 is more than approximately 600 m/min, and preferably about 800-1,200 m/min, e.g., 1,000 m/min, whereas second roll 8 has a circumferential velocity of 10-30 m/min, and preferably of about 20 m/min.

Width of a roll segment 30, 32, 34 or of an intake trough segment 20, 22, 24 is preferably about 250 mm. It is obvious, however, that the individual segments can also have other widths, e.g., widths in the range of 150-400 mm, and that the widths of the individual segments can also be different from each other.

FIG. 2 shows an operating mode for long-staple fibers or for fibers which are not to be opened too much. In this case, rapidly rotating roll 10 rotates in the direction opposite that of first two rolls 6, 8. Pivoting trough 44 now blocks off the right part of lower chute 12. The fibers are discharged from second roll 8, which serves as an intake roll, while the circumferential surfaces of the rolls are both moving in the same direction, and thus the fibers are not combed out across the edge of the shroud 28.

Figure 3:
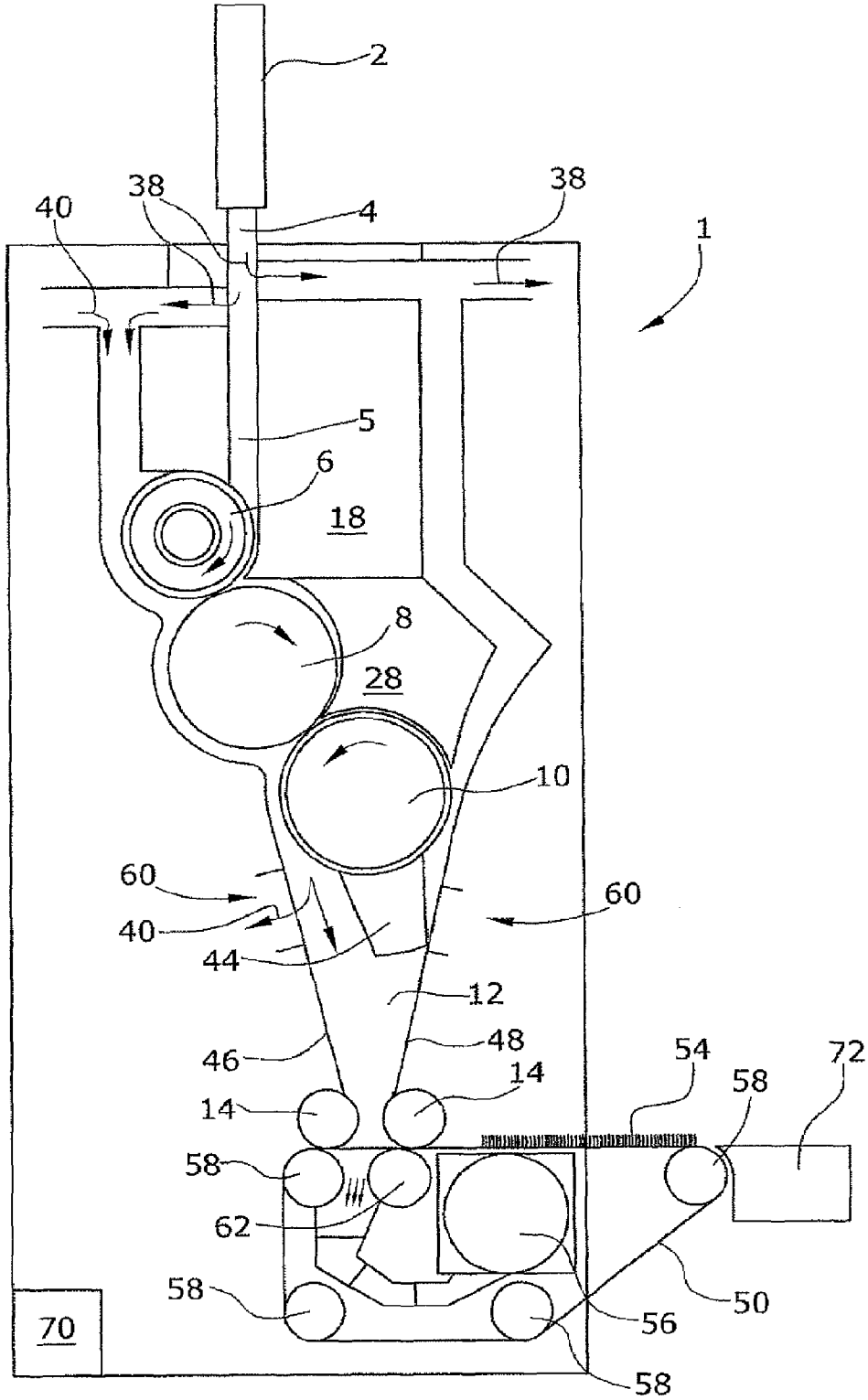
FIG. 3 shows a modification of the exemplary embodiment of FIG. 2 with a lower chute of larger volume.

FIG. 3 shows an operating mode similar to that of FIG. 2, except that pivoting trough 44 underneath rapidly rotating roll 10 is much smaller, so that the volume of lower fiber chute 12 in which the fibers can collect is larger. Pivoting trough 44 is mounted with freedom to pivot, so that rapidly rotating roll 10 can be switched from one mode to another.

FIG. 4 shows an exemplary embodiment in which, instead of the screen belt subjected to suction from underneath, an endless belt 51 is installed under discharge rolls 14.

It is also shown in this exemplary embodiment that chute walls 46, 48 of lower chute 12 can be provided with shaking devices 52, one or the other of which can be operated as a function of the position of pivoting trough 44.

Alternatively or in addition, a shaking device can be mounted in pivoting trough 44.

It is obvious that this alternative embodiment can also be carried over to the exemplary embodiments according to FIGS. 1-3.

This exemplary embodiment differs from the preceding ones in that air stream 40 (and alternatively air stream 42) is not derived from transport air 38 but consists of a separately supplied air stream, e.g., an injected stream of compressed air, preferably conditioned compressed air. Transport air 38 is blown off in this case. Vent devices 60 (not shown in FIG. 4, see instead FIGS. 1-3) in the form of vent combs, for example, are provided in chute walls 46, 48 of lower chute 12.

FIG. 7 shows a cross section through first segmented roll 8, which has a common hollow shaft 36, on which stators 37, 38, 39, one for each roll segment, are mounted. The stators drive the rotors of roll segments 30, 32, 34 via clutches 31, especially hysteresis clutches. The hollow shaft 36 is driven by, for example, an electric motor 76.

The force is transmitted to roll segments 30, 32, 34, which are supported on ball bearings 75, via clutches 31, which can transmit a definable and controllable torque.

In the exemplary embodiment, the clutches are hysteresis clutches, the torque of which changes depending on the variable gap width C between clutch elements 33 and 35.

Hysteresis clutches work without contact and without wear, so that the speed ratios between hollow shaft 36 and roll segments 30, 32, 34 are reached automatically, depending on the amount of torque which is being applied to roll segments 30, 32, 34.

This torque is defined by a spring constant of the fibers of the first compression zone at the end of intake trough 18. It is thus ensured that, for the same torque settings and the same physical properties of the fiber blends, the factual circumferential velocity of the individual segments of segmented roll 6 will be automatically adjusted so that the fiber quantities will be uniform. The quantity of fibers needed can be supplied at any time from upper fiber chute 4.

Thus the fluctuations in the weight of the fiber mat which forms can be smoothed out.

Instead of hysteresis clutches it is also possible to use eddy current clutches with electrically generated magnetic fields.

As an alternative to a torque-controlled clutch, an internal motor, which can perform the same function as a hysteresis clutch in a torque-controlled manner, can be provided in each of individual roll segments 30, 32, 34.

This additional alternative consists in using external rotor motors, wherein, instead of hollow shaft 36 in FIG. 7, a stationary axle is provided, and instead of clutches 31, external rotor motors, in which the stator is seated on the axle and the rotor rotates around the stator, are provided. The external rotor motors serve the same function in a torque-controlled manner as clutches 31.

Between the stator and the rotor, a speed monitoring device 41 can be provided, regardless of whether clutches 31 or motors are used. This monitoring device is connected to a control unit 70 for the torque of the roll segments.

Figure 8:
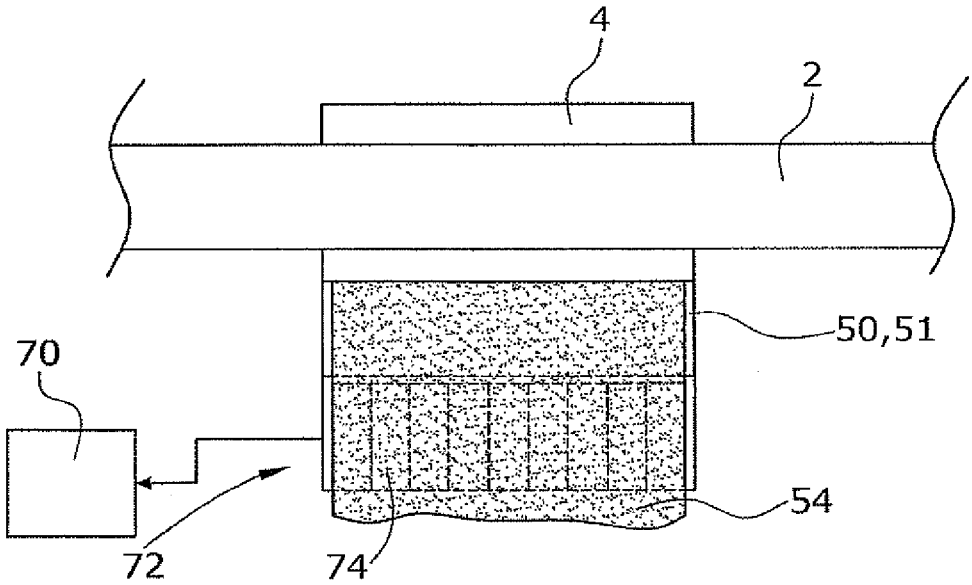
FIG. 8 shows a weighing table with several measuring cells at the discharge point of the fiber mat.

FIG. 8 shows a top view of a fiber mat 54 emerging from the feeding device on endless belt 50 or 51 with a downstream weighing table 72 equipped with several, e.g., nine, adjacent measuring cells 74, by means of which the weight per unit area of emerging fiber mat 54 can be measured. The measuring signal is sent to the control unit for regulating the torque of rolls segments 30, 32, 34, the number and width of which preferably correspond to the number and width of measuring cells 74.

Figure 9:
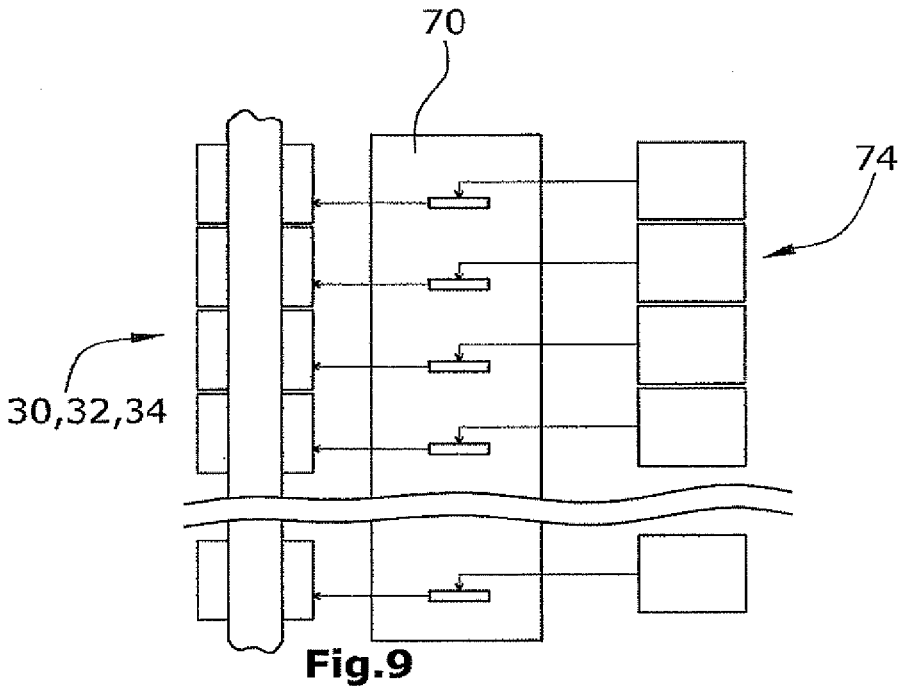
FIG. 9 shows a schematic diagram of the control device for the roll segments as a function of the measurements provided by the measuring cells of the weighing table.

FIG. 9 shows a schematic diagram of the automatic torque control device for the roll segments as a function of the measuring signals from measuring cells 74, which are sent to the control unit for the roll segments.

The invention claimed is:

1. A feeding device for fiber flocks or opened fibers which may be supplied by a pneumatic fiber transport device, for feeding a textile machine, the feeding device comprising:

a first upper vertical fiber chute, which supplies the fibers or fiber flocks to an assembly of at least one roll for the opening of the fibers, and a lower fiber chute, which accepts the fibers released by the assembly of at least one roll and discharges a fiber mat via discharge rolls at the bottom end of the lower fiber chute;

a segmented intake trough having several intake trough segments, which cooperate with a segmented, clothing-covered first roll of the assembly of rolls, the first roll being divided into several roll segments;

wherein the torque of the roll segments can be controlled individually, and the widths of the gaps between the intake trough segments and the opposing roll segments can be adjusted on a segment-by-segment basis.

2. The feeding device according to claim 1 wherein the length of the roll segments is the same as the length of the opposing intake trough segments.

3. The feeding device according to claim 1 wherein the intake trough segments are subdivided more finely than the roll segments.

4. The feeding device according to claim 1 wherein the first roll is made up of roll segments of equal length.

5. The feeding device according to claim 1 wherein:

a first compression zone is formed at the end of the intake trough;

the first roll transfers fiber flocks to a second, clothing-covered roll of the assembly, the second roll rotating in the same direction as the first roll and at the same circumferential velocity as the first roll or at a slower circumferential velocity; and a second roll is provided with a shroud, the distance between which and the second roll decreases in the direction of rotation of the second roll.

6. The feeding device according claim 1 further comprising a rapidly rotating roll of the assembly to discharge densified fiber flocks into the lower chute.

7. The feeding device according to claim 6 wherein a second roll transfers the densified fiber flocks at the end of the shroud to the rapidly rotating roll.

8. The feeding device according to claim 6 wherein the rapidly rotating roll is a pin roll or a clothing-covered roll.

9. The feeding device according to claim 6 wherein an air stream can be supplied to the rapidly rotating roll at the separation point of the fibers to facilitate the separation of the fibers from the rapidly rotating third roll.

10. The feeding device according to claim 9 wherein the air stream consists of transport air branched off from the upper fiber chute.

11. The feeding device according to claim 9 wherein the air stream is formed by externally supplied compressed air.

12. The feeding device according to claim 6 wherein, underneath the rapidly rotating roll, a pivoting trough is switchable between the two air streams in correspondence with the changeable rotational direction of the rapidly rotating roll, so that the air flows along the rapidly rotating roll in the same direction as that in which the roll is rotating.

13. The feeding device according to claim 12 wherein the pivoting trough has a shaking device.

14. The feeding device according to claim 6 wherein the circumferential velocity of the rapidly rotating roll is at least 600 m/min.

15. The feeding device according to claim 14 wherein the circumferential velocity of the rapidly rotating roll is 800-1,200 m/min.

16. The feeding device according to one of claim 1 wherein the roll segments of the first roll are supported on a common shaft, and a clutch transmits a variably adjustable torque to the roll segment in question.

17. The feeding device according to claim 16 wherein the clutch consists of a hysteresis clutch, the transmittable torque of which can be adjusted by way of the distance between opposing clutch elements.

18. The feeding device according to claim 1 wherein each roll segment has an internal drive, the torque of which is adjustable.

19. The feeding device according to claim 1 wherein the torque transmitted to the roll segments is controlled as a function of a segment-based measurement of the weight per unit area of the discharged fiber mat or as a function of a measurement of the level to which the lower fiber chute is filled.

20. The feeding device according to claim 1 wherein the discharge rolls transfer a fiber mat onto a screen belt subjected to suction.

21. The feeding device according to claim 1 wherein the lower fiber chute has chute walls, which are provided with a shaking device for densification.

22. The feeding device according to claim 1 wherein the lower fiber chute has chute walls which are permeable.

23. The feeding device according to claim 1 further comprising a second roll of the assembly, wherein the rotational speed of the shaft of the first roll is considerably greater than that of the second roll.

24. The feeding device according to claim 23 wherein the circumferential velocity of the second roll is 5-30 m/min.

25. The feeding device according to claim 24 wherein the circumferential velocity of the second roll is 15-25 m/min.

26. The feeding device according to claim 1 wherein rotational speed measuring devices are provided to monitor the rotational speed of the roll segments.

27. A method for supplying fibers or fiber flocks to a textile machine, comprising the steps of:

transporting the fibers to an upper fiber chute in a transport air stream, branching off air from the transport air stream in the upper fiber chute and densifying the fibers or fiber flocks, opening the fibers or fiber flocks by means of an assembly of at least one roll, and discharging a fiber mat at the bottom end of a lower fiber chute, wherein the step of opening comprises a segmented opening of the fibers or fiber flocks in several segments extending across the width of the upper fiber chute by means of the individual control of the torque of axially adjacent roll segments of a first roll for the production of an emerging fiber mat with a uniform or predefined cross-sectional profile.

28. The method according to claim 27 wherein the segmented opening is also accomplished by the permanent setting of the width of a gap between the roll segments and corresponding intake trough segments of an intake trough opposite the roll segments.

29. The method according to claim 27 wherein a first compression zone is formed at the outlet of the first roll, and wherein the fiber mat leaving the first roll is transferred to a second, clothing-covered roll, which rotates in the same direction as the first roll at the same circumferential velocity as the first roll or at a slower circumferential velocity.

30. The method according to claim 29 wherein the densified fiber flocks are transferred to a rapidly rotating roll at the end of a compression zone at the second roll.

31. The method according to claim 30 wherein the rapidly rotating roll is operated so that it rotates in the direction opposite that of the first two rolls for the carding of coarse or long fibers and in the same direction as the first two rolls for the carding of short fibers.

32. The method according to claim 30 wherein an air stream is supplied to the rapidly rotating roll at the separation point of the fibers to facilitate the separation of the fibers from the rapidly rotating roll.

33. The method according to claim 27 wherein the torque transmitted to the roll segments is controlled as a function of the segment-by-segment measurement of the weight per unit area of the discharged fiber mat.

34. The method according to claim 27 wherein the fiber mat is transferred onto a screen belt subjected to suction at the outlet of the fiber chute.

* * * * *